US005263522A

United States Patent [19]

Sasko

[11] Patent Number: 5,263,522

[45] Date of Patent: Nov. 23, 1993

[54] APPARATUS FOR REMOVING BARK FROM WHOLE LOGS

[76] Inventor: Jeffry P. Sasko, 147 Lincoln Inn Rd., Columbia, S.C. 29212

[21] Appl. No.: 18,785

[22] Filed: Feb. 17, 1993

[51] Int. Cl.[5] ..... B27C 9/00

[52] U.S. Cl. ..... 144/208 B; 144/208 R; 144/242 R; 144/242 D; 144/245 A; 144/341

[58] Field of Search ..... 144/208 R, 208 B, 242 R, 144/242 D, 245 R, 245 A, 340, 341

[56] References Cited

U.S. PATENT DOCUMENTS

| | | | |
|---|---|---|---|
| 1,281,155 | 10/1918 | Guettler | 144/208 B |
| 1,319,935 | 10/1919 | Thorne | 144/208 |
| 1,966,153 | 7/1934 | Thorne | 144/208 |
| 2,125,529 | 8/1938 | Ullgren | 144/208 B |
| 2,137,451 | 11/1938 | Hillbom | 144/208 |
| 2,647,548 | 8/1953 | Guettler | 144/208 B |
| 2,829,687 | 4/1958 | Ramsdell et al. | 144/208 |
| 3,228,440 | 1/1966 | Ferrabee | 144/208 |
| 3,973,606 | 8/1976 | Carbonneau | 144/208 |
| 4,691,750 | 9/1987 | Nakajima | 144/341 X |
| 4,805,677 | 2/1989 | Wallin | 144/341 X |

FOREIGN PATENT DOCUMENTS

| | | | |
|---|---|---|---|
| 734238 | 3/1966 | Canada | 144/208 R |
| 704516 | 3/1966 | Fed. Rep. of Germany | 144/208 B |
| 87449 | 9/1936 | Sweden | 144/208 B |
| 88737 | 3/1937 | Sweden | 144/208 B |
| 94586 | 1/1939 | Sweden | 144/208 B |
| 95161 | 2/1939 | Sweden | 144/208 B |
| 117703 | 11/1946 | Sweden | 144/208 B |
| 138399 | 12/1952 | Sweden | 144/208 B |
| 154817 | 6/1956 | Sweden | 144/208 B |
| 309818 | 9/1971 | U.S.S.R. | 144/208 R |

OTHER PUBLICATIONS

"Bark Peeling Machines and Methods", Jan. 1949, U.S. Dept. of Agriculture, Forest Service: Publication No. D1730, pp. 14–15 and FIG. 10.

*Primary Examiner*—W. Donald Bray

*Attorney, Agent, or Firm*—Michael A. Mann; Maria Reichmanis

[57] ABSTRACT

An apparatus for removing the bark of whole, or tree-length, logs has an open frame with a feed end, a discharge end, a base and two generally sloping sides, and a plurality of spaced-apart conveyor assemblies positioned along one side of the frame, each conveyor assembly having a plurality of lifters moving in channels. The lifters simultaneously lift the whole logs while advancing the logs incrementally toward the discharge end of the frame, then release the whole logs to fall onto the rest of the logs. The whole logs are maintained in continuous rolling, tumbling, abrading contact to remove the bark without damaging the underlying wood. The apparatus may be supplied with a canopy for use in winter and/or in cold climates in trapping heat of warm water or steam sprayed onto the logs to thaw them. The apparatus may be assembled from trailer-transportable modular units.

20 Claims, 5 Drawing Sheets

10
12
14
16
18
20
32
34
36
38
40
40'
42
48
50

122
184
196
38
124
142
26
130
176
178
182
38
38
190
180
170
40
150
188
22
24
40'
152
172
154
186
172'
104
48
192
192
42
48
192

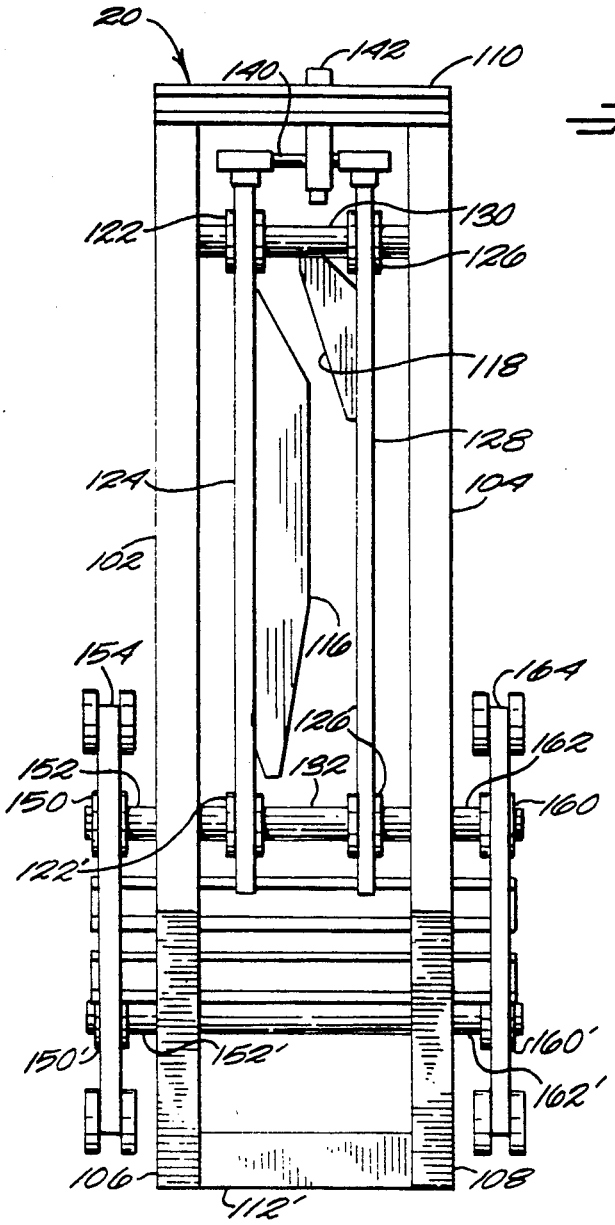
Fig 4
Fig 5
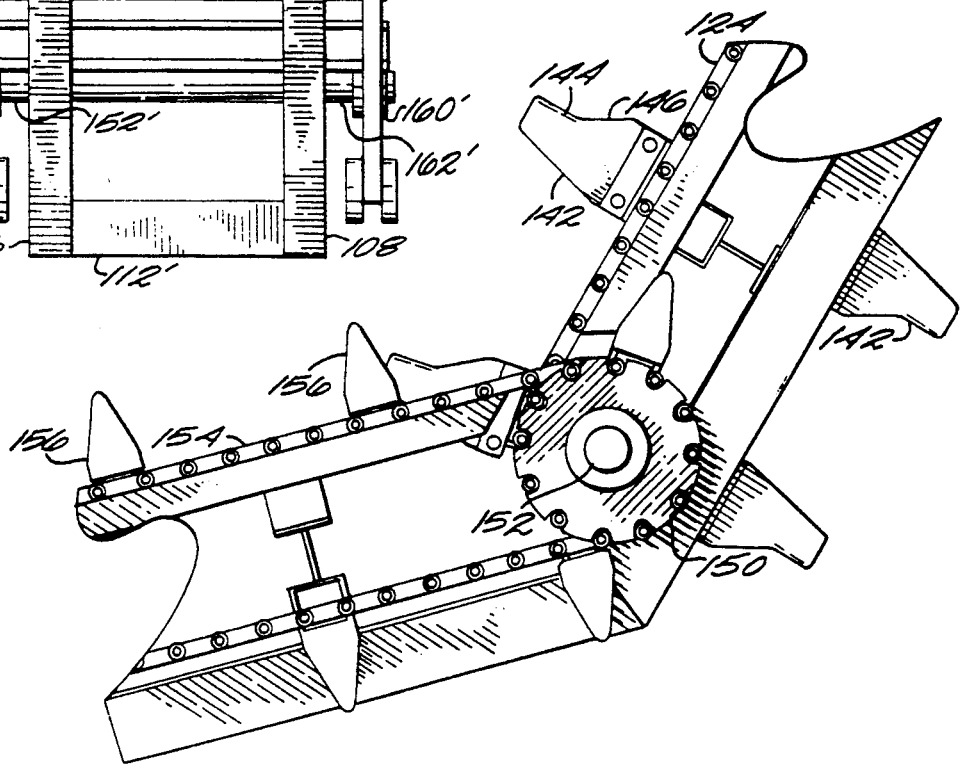

APPARATUS FOR REMOVING BARK FROM WHOLE LOGS

BACKGROUND OF THE INVENTION

1. Field of the Invention:

The present invention relates to a debarking apparatus. More particularly, the invention relates to an apparatus for removing the bark from tree-length logs by causing the logs to rub against one another.

2. Discussion of Background:

Many industrial processes use cut logs from which the bark has been removed. For example, trees are felled, cut into appropriate lengths, stripped of bark before being cut into lumber, manufactured into such products as waferboard and particleboard, or processed into chips for paper-making. The stripped bark may be recovered and used as mulch.

Many types of apparatus are available for debarking logs. Hydraulic peelers direct a stream of pressurized water onto the logs to strip off the bark. Ramsdell, et al. (U.S. Pat. No. 2,829,687) use toothed wheels mounted at an oblique angle with respect to the axis of the log to both turn and advance a log while cutter wheels peel off the bark. More commonly, logs are tumbled in contact with one another in a drum debarker. Bark is rubbed from the exposed surfaces of the logs through contact with the other logs. Drum debarkers consist of a series of large cylinders rotating about their longitudinal axes. Logs are fed upwardly along the rising side of the cylinder. The rotating of the cylinder causes them to roll back towards the opposite side.

Other debarking devices have stationary housings having endless conveyors that move the lowermost logs toward the top, then release the logs to create the tumbling action that debarks the logs. See, e.g., Hillbom (U.S. Pat. No. 2,137,451; Sweden No. 117,703), Ullgren (U.S. Pat. No. 2,125,529), Thorne (U.S. 1,319,935), Olsson (Sweden 94,176), Johansson, et al. (Sweden 88,737). Logs may be moved back and forth both lengthwise and sideways to induce rubbing and shearing action between their exposed surfaces (Wallin, U.S. Pat. No. 4,805,677), or advanced laterally while being tumbled, as in the linked drum sections of Carbonneau (U.S. Pat. No. 3,973,606). Ferrabee (U.S. Pat. No. 3,228,440; Canada 734,238) uses a plurality of movable staves tilted at a desired angle to lift and tumble logs entering the apparatus. The greater the angle, the sooner the logs exit the device. Nilsson, et al. (Sweden 154,817) use chain-driven teeth of different shapes to tilt logs at a desired angle for moving the logs forward. Chain drives are also used in devices for trimming branches from cut trees, as described by Glebov, et al. (U.S.S.R. 309,818).

The ease of debarking is related to the type of wood and the temperature of the logs. Conifers, for example, are easier to debark than deciduous trees such as aspen or oak. In general, debarking is easier in summer than in winter, and easier in warm climates than in cold climates. In winter, especially at northern latitudes where freezing is common, logs may be soaked in water or sprayed with water or steam to facilitate loosening of the bark and speed the debarking process. See, e.g., Hillbom (U.S. Pat. No. 2,137,451), Ormell (Sweden 95,161; 87,449), Olsson (Sweden No. 94,176).

Debarkers are generally designed for batch-processing logs cut to standard lengths such as four feet (about 1.2 m) and eight feet (about 2.4 m) rather than whole logs. Drum debarkers can process whole logs but not without some difficulty. Many debarkers require a crane to hoist a load of logs from a truck or stockpile to their feed end so that the logs move by gravity forward to the exit end.

There is a need for a debarking apparatus that effectively removes bark from full-length cut trees, that processes the logs continuously rather than batchwise and that is easy to feed logs into.

SUMMARY OF THE INVENTION

According to its major aspects and broadly stated, the present invention is an apparatus for removing bark from whole logs. Whole logs are trees that have been cut down and their limbs and branches removed. Whole logs are in contrast with logs that have been cut to a standard length much shorter than a whole log; for example logs can be eight feet (about 2.4 m) or twelve feet (about 3.6 m) long, and whole logs can be fifty feet (about 15 m) or more. Whole logs have a considerably smaller diameter near their top ends than at their butt ends; logs are nearly the same diameter throughout their length.

The apparatus has a frame for supporting the whole logs. The frame has a feed end and an opposing discharge end, a feed section and a discharge section, a base, a first side and an opposing, higher second side. The whole logs are fed into the feed end of the frame from the lower first side and discharged from the discharge section of the frame. The frame has means for both tumbling and advancing whole logs; that is, the tumbling and advancing means advances the whole logs from the feed end to the discharge end while simultaneously lifting them to the top of the second side and allowing them to fall back onto the rest of the whole logs, tumbling them against each other. During tumbling, the whole logs lose their bark by the time they reach the discharge section. The logs are repeatedly lifted and dropped, each time they are advanced a distance toward the discharge end. When the logs reach the discharge section, the tumbling and advancing means lifts the logs to the top of the second side and allows the logs to fall, one at a time, out of the apparatus. Alternatively, the logs exit the apparatus at the discharge end.

Preferably, the advancing and tumbling mean comprises a plurality of conveyors or conveyor pairs, each conveyor pair having a feed-side conveyor and a parallel, spaced apart discharge side conveyor. The conveyor pairs move a series of lifters slidably carried by rods running from the feed side conveyor to the discharge side conveyor. Cams cause the lifters to slide from the feed end of the rods to the discharge end as the lifter moves from the base to the near the top of the second side. Then after the whole log falls back onto the other logs, another cam slides the lifter back to the feed side of the rod. The laterally sliding lifters cause the lifting logs to move a distance towards the discharge end of the frame.

Alternatively, the conveyors can be mounted at an angle so that the logs are lifted to the top of the second side and toward the discharge end from the base and the feed end of the frame.

Finally, the frame may be fitted with a canopy covering the whole logs for trapping heat.

The tumbling and advancing of the logs by the same component is a major feature of the present invention.

Not only is tumbling and advancing simultaneously more efficient, but also whole logs can be debarked and logs can be added at the feed end in batches or continuously without waiting until the initial batch is done. Therefore, the throughput of logs is greater with the present apparatus than in the case of other systems where cut logs are debarked in batches.

The use of either embodiment of the tumbling and advancing mechanism to lift and advance a whole log is another important feature of the present invention. A preferred embodiment uses a pair of conveyor belts with lifters—"teeth"—that are free to slide on rods running from one belt to the other and whose lateral motion on the rods is dictated by cams. The lifters drive the logs one at a time upwards until the pitch of the side of the frame causes them to fall back onto the remainder of the logs. Meanwhile the lifters together with the logs are shifted toward the discharge end by a short, incremental distance. Another embodiment uses conveyors that are mounted at an angle so their lifters lift the logs upwardly and toward the discharge end. In both embodiments, the logs are continuously being stripped of their bark while being advanced to the discharge end. Moreover, the apparatus does not have to be elevated at the feed end to cause the logs to move toward the discharge end.

Still another feature of the present invention is the frame. The frame has two sides, one higher than the other. The higher side carries the conveyor system; the lower side is not more than approximately ten feet from the ground or base on which the frame is placed. This feature allows the user to load logs from a logging truck or stockpile without lifting the logs very high in the air; in fact, most of the logs will be at approximately the same height when on the truck as the lower side of the frame.

Another feature of the present invention is its modular nature. Each module is preferably dimensioned for transport by a standard flatbed truck, approximately 40' (about 12 m) long. Alternatively, the apparatus may be provided with axles and wheels for transportation to the desired location. Several modules can be connected in series for processing full-length trees which are usually more than fifty feet (about 15 m) long.

Still another feature of the invention is the discharge section. In the discharge section, the logs are lifted to the top of the second side and released to fall singularly out of the apparatus to a conveyor or other suitable device. Thus, logs are loaded into the apparatus batchwise, but discharged one at a time. The output of the apparatus consists of singulated logs, which are particularly convenient for further processing.

Still another feature of the invention is the canopy. The canopy covers the frame and traps heat from hot water or steam applied to thaw or warm frozen logs. Allowing the logs to warm makes it easier to remove their bark.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 4 is a view of the converyor assembly according to a preferred embodiment of the present invention;

FIG. 5 is a side, detailed view of the conveyor assembly of FIG. 4;

DETAILED DESCRIPTION OF A PREFERRED EMBODIMENT

Figure 1:
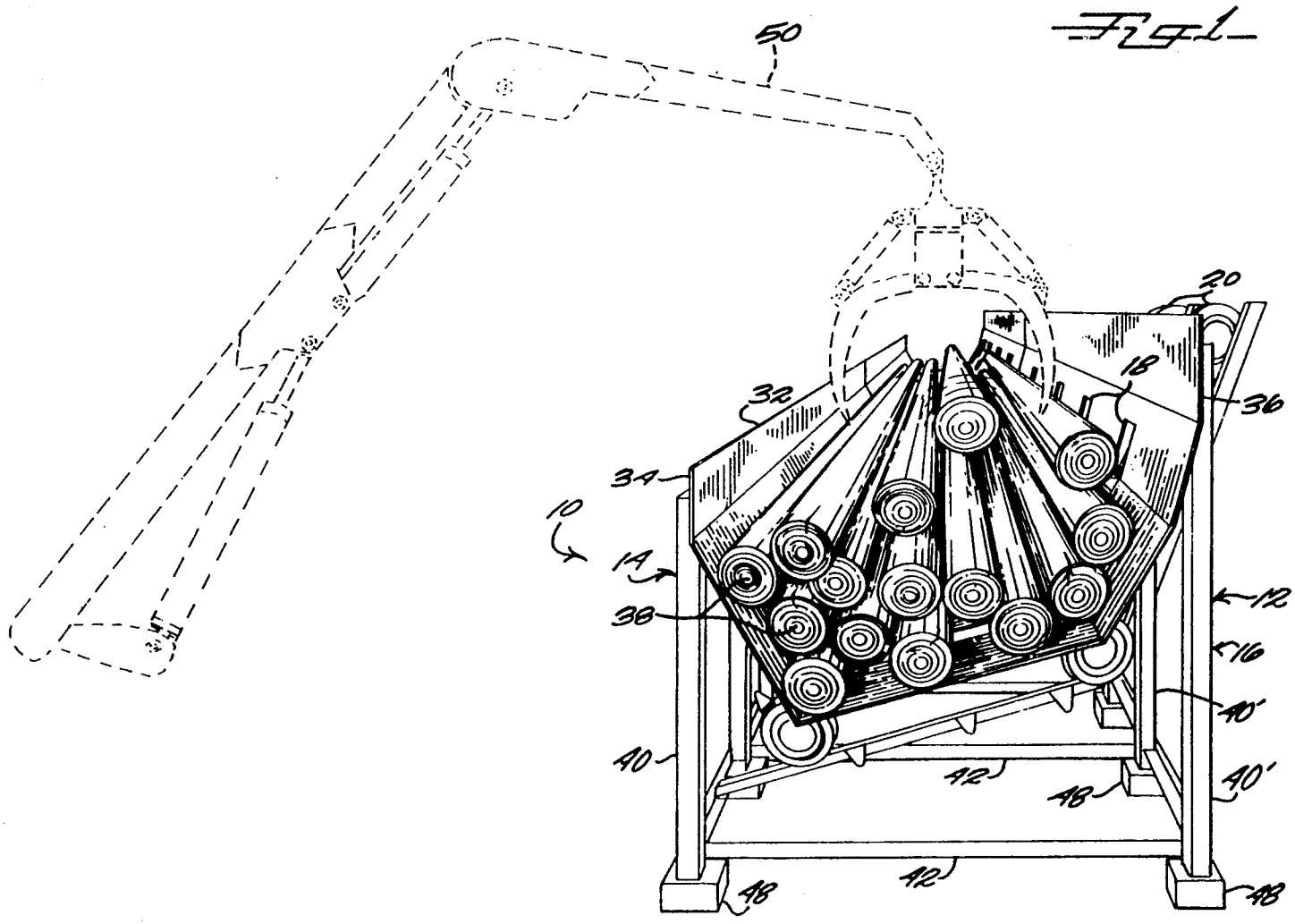
FIG. 1 is a perspective view of an apparatus according to a preferred embodiment of the present invention.

In the following description, similar components are referred to by the same reference numeral in order to simplify the understanding of the sequential aspect of the drawings.

Figure 2:
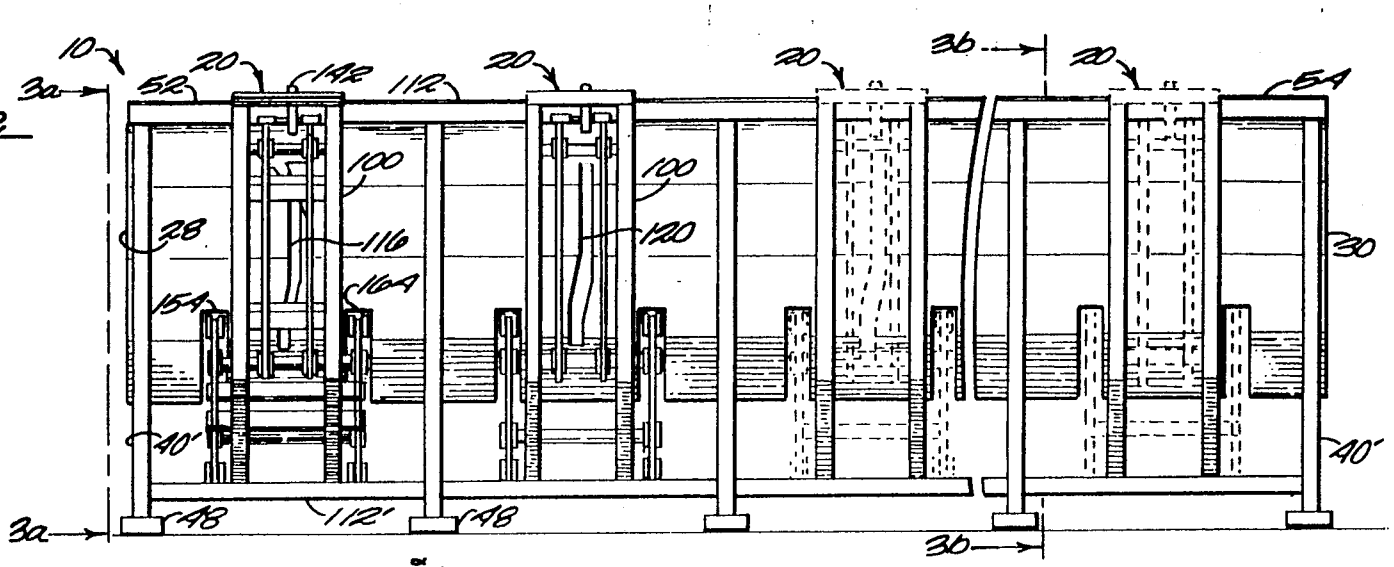
FIG. 2 is a side view of the apparatus of FIG. 1.
Figure 3A:
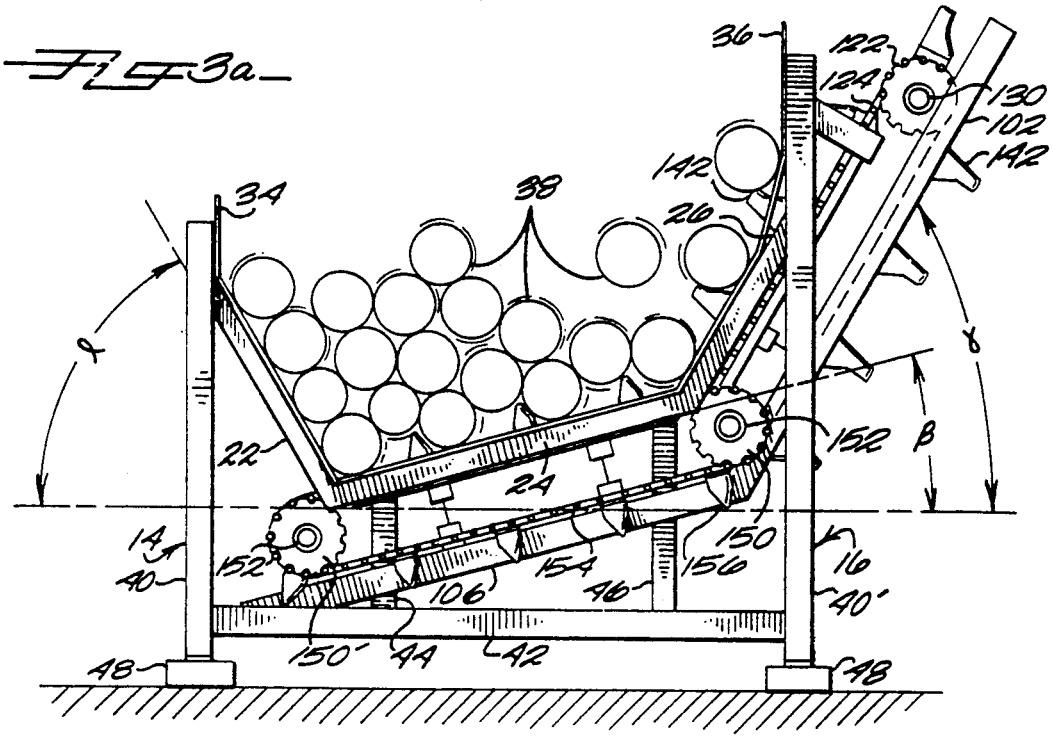
FIG. 3A is a cross-sectional view of the apparatus through the line 3A—3A of FIG. 2.

Referring now to FIG. 1, FIG. 2 and FIG. 3*a*, there is shown a perspective view of an apparatus for removing bark from whole logs according to a preferred embodiment of the present invention. Apparatus 10 comprises frame 12 with first side 14 and second side 16, channels 18, and a plurality of conveyor assemblies 20. Beams 22, 24, and 26 of frame 12 define a log-supporting enclosure having sloping sides and base. Beams 22, 24, 26 form angles $\alpha$ (approximately 60°), $\beta$ (approximately 15°), $\gamma$ (approximately 60°), respectively, to the horizontal, as best seen in FIG. 3A. Frame 12 has feed end 28 and discharge end 30. Enclosure 32, supported by beams 22, 24, 26, has first side 34 and second side 36. Second side 36 is higher than first side 34, facilitating loading of apparatus 10 at first side 34. Frame 12 holds a plurality of whole, tree-length logs 38 (FIGS. 1, 2, 3A).

Frame 12 is supported by a plurality of vertical posts 40, 40' braced by horizontal beams 42. Additional vertical posts 44, 46 may extend between horizontal beams 42 and beams 112 to help support beams 22, 24 and 26. Posts 40, 40' are secured in position by any suitable means, such as anchor bolts tied to concrete blocks 48. For optimum operation, frame 12 is approximately horizontal. It will be understood that frame 12 may be positioned at any convenient height above the ground simply by varying the height of posts 40, 40'. The heights of individual posts 40, 40' may be adjusted to compensate for uneven terrain.

Whole logs 38 are placed into feed end 28 of apparatus 10, butt ends first, by crane 50 or other suitable means. The logs move through feed section 52 to discharge section 54. The debarked logs exit at discharge section 54 one at a time—"singulated"—and are removed by a conveyor, as will be described below. Alternatively, the debarked logs are removed by a crane, forklift, or other suitable means at discharge end 30. Apparatus 10 may include conveyors (not shown) for feeding logs into feed end 28 and for removing debarked logs from discharge section 54. A conveyor may be positioned beneath apparatus 10 to receive and carry away bark fragments that are stripped from the logs inside apparatus 10.

A plurality of conveyor assemblies 20 are disposed along second side 16 of apparatus 10 (FIG. 2). Each assembly 20 of feed section 52 is mounted on a supporting frame 100, formed of upper beams 102, 104, lower beams 106, 108, and braces 110, 110' between upper beams 102 and 104. Frame 100 is attached to side beams 112, 112' of frame 12 by any suitable means, such as bolts, screws, rivets, welds, and so forth.

As best seen in FIG. 4, conveyor assembly 20 has first, feed-side upper gear wheels 122, 122' carrying first endless belt or chain 124. Second, discharge-side upper gear wheels 126, 126' carry second endless belt or chain 128. Wheels 122 and 126 are mounted on common shaft 130. Similarly, wheels 122' and 126' are mounted on common shaft 132. Chains 124 and 128 are connected by a plurality of transverse rods 140, so that the relative alignment of chains 124 and 128 is maintained as the chains move about wheels 122 and 122', and wheels 126 and 126', respectively. Wheels 122, 122', 126, 126' are turned by suitable conventional means (not shown).

An upper lifter 142 is slidably mounted on each rod 140 (FIGS. 3A, 4, 5). If desired, additional rods or spacers 140, without upper lifters 142, may be provided to help maintain the relative alignment of chains 124 and 128. Lifters 142 are shaped and dimensioned to carry whole logs 38 upwards as chains 124, 128 move upwards. Lifters 142 may be of any convenient shape, but preferably have a height in the approximate range of the radius of the trees processed by apparatus 10. By way of example, lifters 142 that are approximately 10" (about 25 cm) high can accommodate a wide range of tree sizes. Leading edges 144, 146 of upper lifters 142 may form an oblique angle, with edge 144 approximately perpendicular to chains 124, 128, as best seen in FIG. 5. Alternatively, edge 144 may be approximately parallel to the centerline of a log carried by lifter 142, thus offset by about 2° from the perpendicular.

As chains 124, 128 move upwards in the direction of incline of beam 26, upper lifters 142 engage cams 116, 118 and slide laterally on rods 140 as the lifters move vertically in the path defined by the cams. Thus, a log 38 carried by a lifter 142 is simultaneously raised upwards and moved laterally a distance from feed end 28 towards discharge end 30 of apparatus 10. Logs 38 are released near the top of second side 36, and lifters 142 slide laterally a distance from discharge end 30 towards feed end 28 as the lifters move downwards. Lifters 142 are preferably slidable for several inches, preferably approximately 6" (about 15 cm). The shape, dimensions, and positions of cams 116, 118, determine the amount of lateral motion imparted to lifters 142 by the cams. The optimum configuration of cams 116, 118, therefore depends on such factors as the species of wood to be processed and the ambient temperature.

Cams 116, 118 may be adjusted to accommodate different species of wood and variations in temperature. It is well known that the speed of debarking depends in part on the temperature of the logs. Thus, in summer or in warm climates, cam 116 may be extended to impact more lateral motion to logs 38, thereby lessening processing time. Conversely, in winter or in colder climates, cam 116 may be retracted to impart less lateral motion to the logs, increasing residence time in apparatus 10 for more effective debarking.

Two sets of lower gear wheels are positioned as shown in FIG. 4. First, feed-side lower gear wheels 150, 150', mounted on shafts 152, 152', respectively, carry endless chain or belt 154. Chain 154 carries a plurality of lower lifters 156 (FIG. 5). Second, discharge-side lower gear wheels 160, 160' are mounted on shafts 162, 162', respectively, and carry second chain or belt 164 with lower lifters 166. Wheels 150 and 160 are preferably mounted on a common shaft, as are wheels 150' and 160'. Similarly, wheels 150, 122', 126', 160' may be mounted on a common shaft. Wheels 150, 150', 160, 160' are turned by suitable conventional means (not shown). Each conveyor assembly 20 may be driven by an individual power source (not shown), or the conveyor assemblies may be connected by a common shaft and driven by the same source.

Lower lifters 156, 166 are shaped and dimensioned to move logs 38 generally upwards as chains 154, 164 move upwards in the direction of incline of beam 24. Lifters 156 and 166 may be of similar shape to lifters 142, or, alternatively, a wedge or other convenient shape.

Figure 3B:
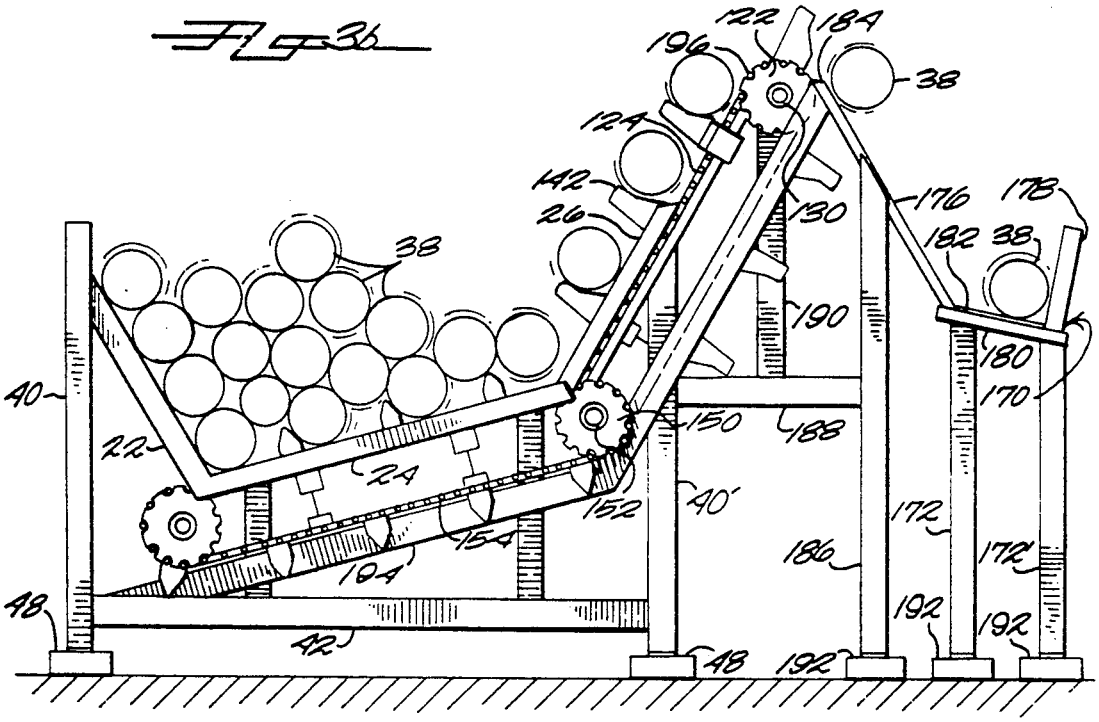
FIG. 3B is a cross-sectional view of the apparatus through the line 3B—3B of FIG. 2.

As best seen in FIGS. 4 and 5, chains 124 and 128 are positioned between upper members 102, 104 of supporting framework 100. Channels 18 formed in enclosure 32 (FIG. 1) accommodate lifters 142, 156, and 166, and shield chains 124, 128, 154 and 164 from contact with whole logs 38. Alternatively, enclosure 32 may be omitted and chains 124, 128, 154 and 164 positioned such that only lifters 142, 156 and 166 protrude above beams 24 and 26 (FIGS. 3B, 5). Thus, only lifters 142, 156, and 166 contact logs 38. This reduces wear on the chains and lessens the maintenance costs of apparatus 10.

A cross-sectional view of discharge section 54 is shown in FIG. 3B. A discharge assembly 170 is positioned generally parallel to discharge section 54. Discharge assembly 170 includes vertical posts 172, 172', sloping sides 176 and 178, and a base 180. A suitable conveyor 182 is positioned in the enclosure formed by sides 176, 178 and base 180. First side 176 has an upper end 184, positioned generally as shown in FIG. 3B. If desired, an additional vertical post 186 supports first side 176. Vertical post 186 is connected to frame 12 of apparatus 10 by horizontal brace 188, and to frame 100 of conveyor assembly 20 by vertical brace 190. Posts 172, 172', 186 are secured in position by any suitable means, such as anchor bolts tied to concrete blocks 192. Base 180 and conveyor 182 are positioned at a convenient height relative to apparatus 10.

As shown in FIG. 3B, conveyor assemblies 194 are generally similar to conveyor assemblies 20 described above. However, enclosure 32 (if present) is formed without a raised side 36. Thus, when lifters 142 release a log 38 at the top 196 of a conveyor assembly 194, the log falls onto upper end 184 of side 176 and rolls downwards to conveyor 182. If desired, upper end 184 may be spaced apart from upper end 196 of conveyor assembly 194. However, it will be understood that upper end 184 is positioned so that logs 38 fall easily onto side 176. Side 176 is preferably angled so that logs 38 roll smoothly downwards to conveyor 182. Each conveyor assembly 194 may be driven by an individual power source, or the conveyor assemblies may be connected by a common shaft and driven by the same source.

Logs 38 are loaded butt end first into feed section 52 of apparatus 10. Alternatively, the logs may be input into feed end 28 by a conveyor or other suitable means. In feed section 52, lower lifters 156, 166 of conveyor assemblies 20 operate to move logs 38 generally upwards along the direction of incline of beam 24. Upper lifters 142 engage the logs, simultaneously moving the logs upwards in the direction of incline of beam 26 and forwards a distance, then release the logs to tumble downwards. Thus, lower lifters 156, 166, carried by lower chains 154, 164, cooperate with upper lifters 142 carried by upper chains 124, 128 to both raise logs 38 and move the logs from feed end 28 towards discharge end 30. The logs are advanced and tumbled against one another as they move through apparatus 10. The tumbling action of the logs induces friction and rubbing between their exposed surfaces to scrape the bark off the logs.

When the logs reach discharge section 54, upper lifters 142 of conveyor assemblies 194 move the logs upwards. When the logs reach top 196, lifters 142 release the logs to roll downwards along side 176 to conveyor 182. If desired, apparatus 10 may be provided without a discharge section 54 so that logs 38 exit batchwise from the apparatus. Preferably, however, the logs are discharged one at a time from discharge section 54 onto conveyor 182. The logs are loaded into apparatus 10 batchwise, debarked, and singulated logs are discharged from discharge section 54.

The logs may be inspected upon leaving apparatus 10, and, if desired, inadequately debarked logs may be returned to feed end 28 for reprocessing. Once a log has been adequately debarked, it is transported to a saw, chipper, etc., for further processing.

The bark fragments fall through the gaps in frame 12, onto the ground or a conveyor, if desired. Continuously removing scraped-off bark fragments eliminates the need to shut down apparatus 10 to clean out accumulated bark. If desired, the bark fragments may be run through a chipper ("hog") to reduce the chips to a convenient size for use. For example, approximately 1"-2" (2-5 cm ) chips are readily usable as mulch, and smaller chips or shreds may be used in paper manufacture.

The log-bearing surfaces of apparatus 10, including channels 18 (if present), beams 22, 24, and 26 of frame 12, and lifters 142, 156, and 166, can be arranged at various angles relative to one another and at various angles with respect to the horizontal plane. The optimum arrangement of these components depends on such factors as the climate and the type of wood being processed, and is best determined by a modest amount of computation and experimentation for each particular design.

Figure 6:
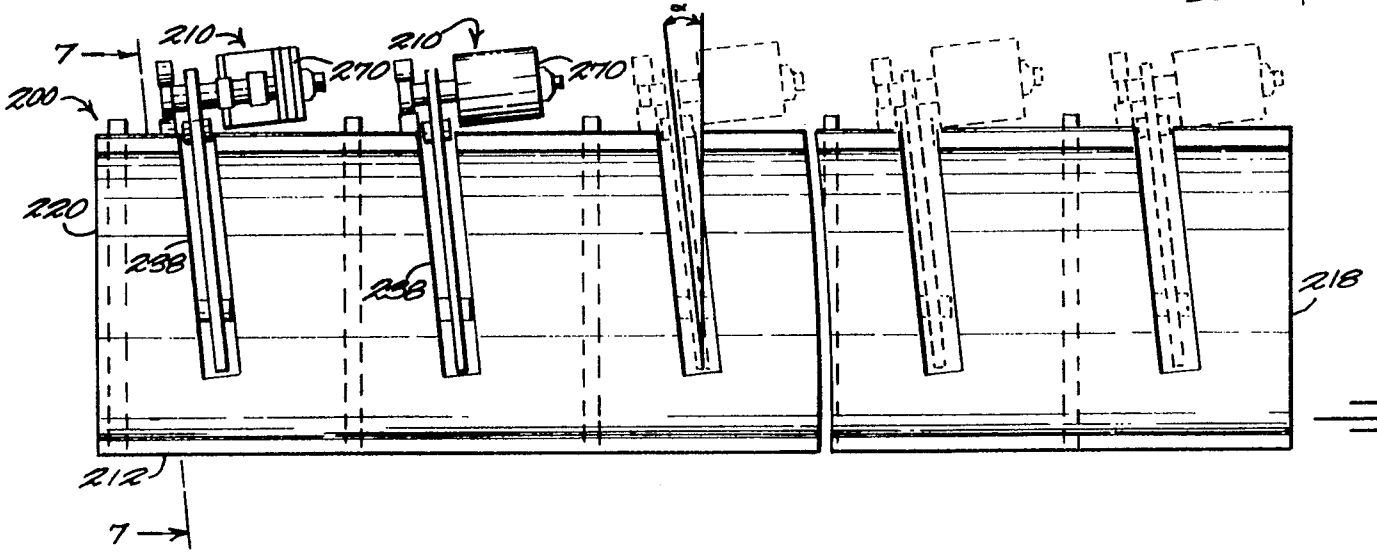
FIG. 6 is a side view of an apparatus according to an alternative preferred embodiment of the present invention.
Figure 7:
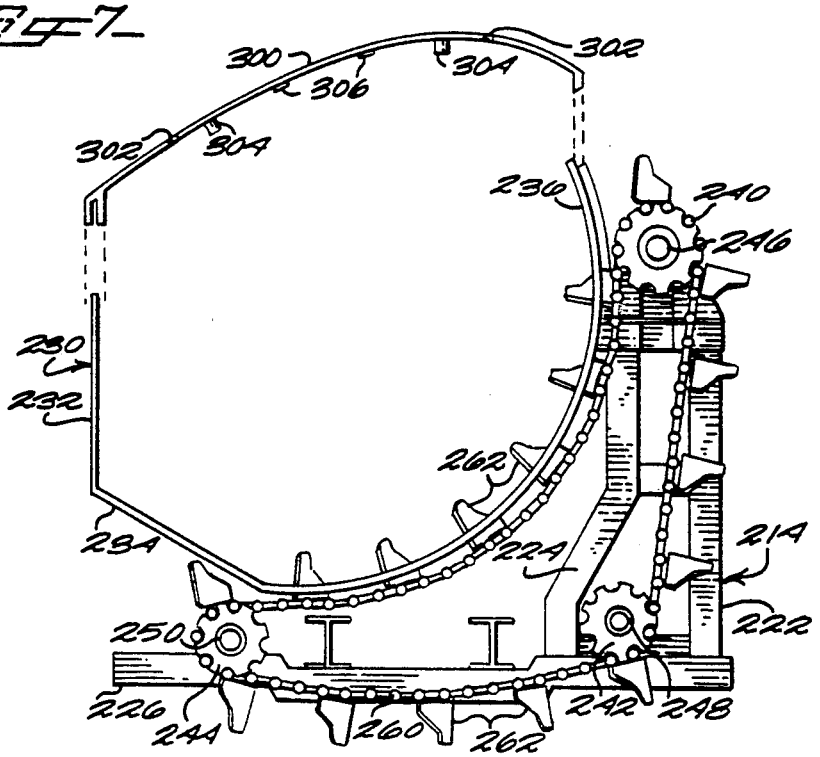
FIG. 7 is a cross-sectional view through the line 7—7 of FIG. 6.

An alternative embodiment of the present invention is shown in FIGS. 6 and 7. Apparatus 200 has a plurality of conveyor assemblies 210 mounted on frame 212. Each assembly 210 is mounted on a supporting frame 214, at an angle $\alpha$ to the vertical. Apparatus 200 has a feed section 218 and a discharge section 220.

Supporting frames 214 each have generally upright beams 222, 224, and horizontal beams 226 (FIG. 7). A frame 212 supports a perforated container 230, having a generally vertical side portion 232, a sloping lower portion 234, and a curved side portion 236. Container 230 has channels 238 formed therein, each channel having a conveyor assembly 210 positioned thereat.

Conveyor assembly 210 has gear wheels 240, 242, and 244, journalled on shafts 246, 248, and 250, respectively, and carrying endless chain or belt 260. A chain 260 carries a plurality of lifters 262, which are preferably of similar shape and dimensions to lifters 142 of apparatus 10 described above. Frames 214 may assume any configuration that effectively supports conveyor assemblies 210.

Each conveyor assembly 210 is supplied with a motor 270 for driving wheels 244, or, alternatively, wheels 240 or 242 (FIG. 6). If desired, wheels 244 (or wheels 240 or 242) of assemblies 210 may be mounted on a common shaft and driven by a common motor (not shown).

Whole, tree-length logs are fed into apparatus 200 at feed section 218. The logs are simultaneously raised and moved a distance from feed end 218 towards discharge section 220 by lifters 262. The tumbling action of the logs after they are released by lifters 262 induces frictional contact between their exposed surfaces, effectively abrading bark from the logs. The angled position of conveyor assemblies 210 serves to simultaneously move the logs forwards as they are raised by lifters 262. The stripped logs exit apparatus 200 at discharge section 220. The bark fragments fall out of channels 238, and may be carried away by a conveyor. Thus, bark fragments are not retained within apparatus 200. If desired, curved side portions 236 of conveyor assemblies 210 may be generally higher for those assemblies 210 mounted along feed section 218, and lower for assemblies mounted along discharge section 220. Then, logs 38 are released one at a time as the logs reach the top of discharge section 220, and roll downwards to a conveyor (not shown), as described above for apparatus 10. Thus, logs may be loaded into apparatus 200 batchwise, but are discharged singularly.

The optimum processing time in apparatus 200, as in apparatus 10, depends on the species and temperature of the wood being processed. Soft-barked species and warmer temperatures require shorter residence times since debarking is easier. Conversely, hard-barked species and colder temperatures require longer residence times. The larger the angle $\alpha$, the faster the logs are moved forwards and the shorter the residence time of the logs in apparatus 200. The angle is small, generally no more than approximately 5°. While it is expected that the angle $\alpha$ will be chosen for the coldest expected log temperature in area where apparatus 200 will be used, the optimum angle is best determined by observation and a modest degree of experimentation for each particular situation.

Apparatus 10 and apparatus 200 may be supplied with a canopy 300 (shown in cross-section in FIG. 7) for use in winter and/or in cold climates. In addition to canopy 300, there may be provided a source of warm water or steam to the apparatus for warming logs 34 to ease debarking. Canopy 300 may incorporate a plurality of holes 302, injection nozzles 304, perforated pipes 306, or other means for supplying water or steam to the interior of the apparatus. Canopy 300 is preferably removable from the apparatus during warm weather, but readily placeable over the apparatus in cold weather or when frozen logs are to be processed.

Apparatus 10 and apparatus 200 are preferably dimensioned for convenience in transporting and assembling the apparatus for use. By way of example, the apparatus may be dimensioned for transport on a standard-sized flat-bed truck, such as an approximately 40' (about 12 m) long trailer. Alternatively, the apparatus may be provided with axles and wheels for transportation to the desired location.

The optimum number of conveyor assemblies for apparatus 10 and apparatus 200 depends on the dimensions of the apparatus, the expected environment of use, and the species of trees to be debarked. Apparatus 10 may have, for example, four conveyor assemblies 20, evenly spaced at approximately 9'9" (about 3.0 m) intervals along second side 16. Similarly, apparatus 200 may have five conveyor assemblies 210 spaced approximately 8' (about 2.4 m) apart. If appropriate, however, a different number of conveyor assemblies may be used without departing from the spirit of the present invention.

A debarking apparatus according to the present invention is modular so that several modules can be connected in series for processing full-length trees. The number used depends on the anticipated length of the trees to be processed. To process different species of trees in the same apparatus, batches of trees can be placed into the apparatus at any point along its length. Hardwoods typically require longer processing times, therefore a longer length of apparatus. Softwoods require shorter processing times, and can be input into the apparatus at an intermediate location to traverse a shorter length of the apparatus.

A debarking apparatus according to the present invention maintains whole logs in continuous rolling, tumbling, abrading contact to effectively remove the bark from the logs. The bark is removed from the logs without significant damage to the underlying wood. The apparatus is simple, rugged, and durable. The apparatus contains few movable parts that may be worn by contact with the logs: only lifters 142, 156, 166 of apparatus 10 and lifters 262 of apparatus 200 contact the logs. Maintenance requirements are reduced due to reduced wear on chains 124, 128, 154, and 164 of apparatus 10, and chain 260 of apparatus 200.

The throughput of a debarking apparatus depends on the length and diameter of the logs to be processed, the number of logs that can be processed at one time, the speed at which logs can be passed through the apparatus, and so forth. In the southeastern United States, presently-available debarkers typically produce about 70 cords/hour in winter and 100 cords/hour in summer. The throughput of apparatus 10 and apparatus 200 depends on the speed at which logs are moved through the apparatus (discussed above), and also on the tumbling action imparted to the logs by the apparatus. While the optimum degree of tumbling will depend on the particular apparatus, effective debarking generally requires in the range of approximately 150–750 tumbles/log.

The speed at which the lifters of each apparatus raise the logs affects the degree of tumbling imparted to the logs. The optimum speed depends on the dimensions of the apparatus, the species of wood to be processed and the temperature, and is best determined by observation and a modest degree of experimentation for each particular apparatus. In apparatus 10, the speed at which lifters 142, 156, 166 raise logs 38 is controlled by adjusting the rotational speed of wheels 122, 122', 126, 126', 150, 150', and 160, 160'. In apparatus 200, the speed is controlled by adjusting the rotational speed of wheels 240, 242, 244.

An apparatus according to the present invention is mounted close to the ground, so it is easily loaded from a conventional logging truck with a crane or forklift. As noted above, the apparatus is ready to use: it need only be transported to the desired location and positioned for use. The output of apparatus 10 and apparatus 200 consists of singulated logs, which are particularly convenient for further processing. For example, production of oriented strand board (waferboard) requires logs that are arranged longitudinally for processing. This is usually done manually. Logs debarked by apparatus 10 or apparatus 200 need only be output onto a conveyor and released into the proper position, saving labor costs.

The apparatus is capable of processing full-length cut trees. The full length of the cut trees can be contained inside the apparatus, reducing the incidence of bent or broken logs during debarking operations. The apparatus continuously processes discrete batches of whole logs, that is, logs are loaded into the apparatus in batches, and succeeding batches are added at intervals as each preceding batch moves forwards. There is no down-time while logs are loaded into the apparatus, nor while stripped logs are unloaded from the apparatus.

It will be apparent to those skilled in the art that many changes and substitutions can be made to the preferred embodiment herein described without departing from the spirit and scope of the present invention as defined by the appended claims.

What is claimed is:

1. An apparatus for removing bark from whole logs, said apparatus comprising:

a frame for supporting said whole logs, said frame having a feed end and an opposing discharge end, said whole logs being fed into said feed end and discharged from said discharge end; and means carried by said frame for tumbling and advancing said whole logs, said tumbling and advancing means advancing said whole logs from said feed end to said discharge end while tumbling said whole logs against each other whereby said bark is removed from said whole logs.

2. The apparatus as recited in claim 1, wherein said frame is dimensioned to contain a plurality of whole logs and said tumbling and advancing means further comprises means for lifting, said lifting means lifting at least one whole log of said plurality of whole logs above said plurality of whole logs and moving said at least one whole log laterally from toward said feed end to toward said discharge end whereby said at least one whole log is advanced a distance before said lifting means allows said at least one whole log to fall onto said plurality of whole logs.

3. The apparatus as recited in claim 1, wherein said frame is dimensioned to contain a plurality of whole logs and said tumbling and advancing means further comprises a plurality of conveyors, said conveyors lifting at least one whole log of said plurality of whole logs above said plurality of whole logs and moving said at least one whole log laterally from toward said feed end to toward said discharge end, advancing said at least one whole log a distance before said plurality of conveyors allow said at least one whole log to fall onto said plurality of whole logs.

4. The apparatus as recited in claim 1, wherein said frame is dimensioned to contain a plurality of whole logs, and said tumbling and advancing means further comprises a plurality of conveyor pairs, each of said conveyor pairs having a feed-side conveyor and a discharge side conveyor, said feed-side conveyor being closer to said feed end of said frame and said discharge-side conveyor being closer to said discharge end of said frame, said conveyors lifting at least one whole log of said plurality of whole logs above said plurality of whole logs and then allowing said at least one whole log to fall onto said plurality of whole logs, said each conveyor pair having:

a plurality of lifters, a plurality of rods attached to said each conveyor pair, each rod having a feed end and a discharge end, said feed end attached to said feed-side conveyor and said discharge end attached to said discharge-side conveyor, each lifter of said plurality of lifters slidably carried by one rod of said plurality of rods, and means for sliding said lifters from said feed ends of said plurality of rods to said discharge ends as said lifters lift said at least one whole log, said sliding means returning said lifters from said discharge ends of said rods to said feed ends after said at least one whole log falls from said lifters, said sliding means moving said at least one whole log laterally from said feed end of said frame toward said discharge end, advancing said at least one whole log a distance before said plurality of conveyor pairs allows said at least one whole log to fall onto said plurality of whole logs.

5. The apparatus as recited in claim 1, wherein said frame is dimensioned to contain a plurality of whole logs and said tumbling and advancing means further comprises a plurality of conveyors mounted to said frame at an angle so that said conveyors lift at least one whole log of said plurality of whole logs above said plurality of whole logs and toward said discharge end from said feed end so that said at least one whole log is advanced a distance toward said discharge end before said plurality of conveyors allows said at least one whole log to fall onto said plurality of whole logs.

6. The apparatus as recited in claim 1, wherein said frame further comprises:

a base;

a first side; and an opposing second side having a top, said tumbling and advancing means carried at least in part by said second side, said second side pitched so that said whole logs will fall from said tumbling and advancing means toward said base when lifted to said top of said second side.

7. The apparatus as recited in claim 1, wherein said frame further comprises:

a base;

a first side; and an opposing second side having a top, said first side being lower than said second side, said tumbling and advancing means carried at least in part by said second side, said second side pitched so that said whole logs will fall from said tumbling and advancing means toward said base when lifted to said top of said second side.

8. The apparatus as recited in claim 1, wherein said frame further comprises:

a base;

a first side; and an opposing second side having a top, said first side being lower than said second side and less than approximately ten feet above said base, said tumbling and advancing means carried at least in part by said second side, said second side oriented so that said whole logs will fall from said tumbling and advancing means toward said base from said top of said second side.

9. The apparatus as recited in claim 1, further comprising a canopy carried by said frame and positioned over said frame so that said canopy can cover whole logs in said frame, said canopy adapted for trapping heat.

10. An apparatus for removing bark from whole logs, said apparatus comprising:

a frame for supporting said whole logs, said frame having a feed end and an opposing discharge end, a base, a first side and an opposing second side, said first side being lower than said second side, said whole logs being fed into said feed end from said first side and discharged from said discharge end, said frame being dimensioned for containing a plurality of whole logs; and means carried by said second side of said frame for lifting at least one whole log of said plurality of whole logs above said plurality of whole logs and moving said at least one whole log laterally from toward said feed end to toward said discharge end whereby said at least one whole log is advanced a distance before said lifting means allows said at least one whole log to fall onto said plurality of whole logs.

11. The apparatus as recited in claim 10, wherein said lifting means further comprises a plurality of conveyors.

12. The apparatus as recited in claim 10, wherein lifting means further comprises a plurality of conveyor pairs, each of said conveyor pairs having a feed-side conveyor and a discharge side conveyor, said feed-side conveyor being closer to said feed end of said frame and said discharge-side conveyor being closer to said discharge end of said frame, said each conveyor pair having:

a plurality of lifters, a plurality of rods attached to said each conveyor pair, each rod having a feed end and a discharge end, said feed end attached to said feed-side conveyor and said discharge end attached to said discharge-side conveyor, each lifter of said plurality of lifters slidably carried by one rod of said plurality of rods, and means for sliding said lifters from said feed ends of said plurality of rods to said discharge ends as said lifters lift said at least one whole log, said sliding means returning said lifters from said discharge ends of said rods to said feed ends after said at least one whole log falls from said lifters.

13. The apparatus as recited in claim 10, wherein said lifting means further comprises a plurality of conveyors mounted to said frame at an angle so that said conveyors lift at least one whole log of said plurality of whole logs above said plurality of whole logs and toward said discharge end from said base and said feed end.

14. The apparatus as recited in claim 10, wherein said second side has a top and is pitched so that said whole logs will fall from said lifting means toward said base when lifted to said top of said second side.

15. The apparatus as recited in claim 10, wherein second side has a top and said first side is less than approximately ten feet above said base, said second side pitched so that said whole logs will fall from said lifting means toward said base from said top of said second side.

16. The apparatus as recited in claim 10, further comprising a canopy carried by said frame and positioned over said frame so that said canopy can cover said whole logs in said frame, said canopy adapted for trapping heat.

17. An apparatus for removing bark from whole logs, said apparatus comprising:

a frame for supporting said whole logs, said frame having a feed end and an opposing discharge end, a base, a first side and an opposing second side, said first side being lower than said second side, said second side having a top, said whole logs being fed into said feed end from said first side and discharged from said discharge end, said frame being dimensioned for containing a plurality of whole logs; and means carried by said base and said second side of said frame for conveying at least one whole log of said plurality of whole logs to said top of said second side while moving said at least one whole log laterally from toward said feed end to toward said discharge end whereby said at least one whole log is advanced a distance before said lifting means allows said at least one whole log to fall onto said plurality of whole logs.

18. The apparatus as recited in claim 17, further comprising:

a discharge section at said discharge end of said frame, said discharge section having a base, a first side, an opposing second side having a top, a first end and a second end, said whole logs being fed into said first end of said discharge section from said discharge end of said frame, said second side pitched so that said whole logs will fall out of said discharge section when lifted to said top; and means carried by said discharge section for lifting at least one whole log of said plurality of whole logs towards said top and moving said at least one whole log laterally from toward said first end toward said second end whereby said at least one whole log is advanced a distance before said lifting means allows said at least one whole log to fall out of said discharge section.

19. The apparatus as recited in claim 17, wherein conveying and moving means further comprises a first plurality of conveyor pairs carried by said base and a second plurality of conveyor pairs, each of said second conveyor pairs having a feed-side conveyor and a discharge side conveyor, said feed-side conveyor being closer to said feed end of said frame and said discharge-side conveyor being closer to said discharge end of said frame, said each second conveyor pair having:

a plurality of lifters, a plurality of rods attached to said each second conveyor pair, each rod having a feed end and a discharge end, said feed end attached to said feed-side conveyor and said discharge end attached to said discharge-side conveyor, each lifter of said plurality of lifters slidably carried by one rod of said plurality of rods, and means for sliding said lifters from said feed ends of said plurality of rods to said discharge ends as said lifters lift said at least one whole log, said sliding means returning said lifters from said discharge ends of said rods to said feed ends after said at least one whole log falls from said lifters.

20. The apparatus as recited in claim 17, wherein said conveying and moving means further comprises a first plurality of conveyors mounted to said base and a second plurality of conveyors mounted to said second side at an angle so that said conveyors lift at least one whole log of said plurality of whole logs to said top and toward said discharge end from said base and said feed end.

* * * * *